US007891515B2

(12) United States Patent
Bourgoin et al.

(10) Patent No.: US 7,891,515 B2
(45) Date of Patent: Feb. 22, 2011

(54) WATER SOLUBLE CONTAINER WITH RIGID SPACER

(75) Inventors: Philippe Bourgoin, Pully (CH); Paul John Duffield, Beverley (GB); Fabienne Miler, Brimington (GB); Ralf Wiedemann, Griesheim (DE)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 1427 days.

(21) Appl. No.: 10/523,461

(22) PCT Filed: Aug. 5, 2003

(86) PCT No.: PCT/GB03/03427

§ 371 (c)(1),
(2), (4) Date: Apr. 13, 2005

(87) PCT Pub. No.: WO2004/014753

PCT Pub. Date: Feb. 19, 2004

(65) Prior Publication Data

US 2006/0049076 A1 Mar. 9, 2006

(30) Foreign Application Priority Data

Aug. 7, 2002 (GB) ..... 0218375.4

(51) Int. Cl.
*B65D 21/02* (2006.01)

(52) U.S. Cl. ..... 220/23.83

(58) Field of Classification Search ..... 220/23.83, 220/23.86

See application file for complete search history.

(56) References Cited

U.S. PATENT DOCUMENTS

| | | | | |
|---|---|---|---|---|
| 3,324,993 | A * | 6/1967 | Bruno | 206/577 |
| 4,410,441 | A | 10/1983 | Davies et al. | 206/0.5 |
| 4,835,804 | A | 6/1989 | Arnau-Munoz et al. | 8/158 |
| 7,135,135 | B2 * | 11/2006 | Anderson | 264/173.16 |
| 7,407,923 | B2 * | 8/2008 | Wiedemann et al. | 510/296 |

FOREIGN PATENT DOCUMENTS

| | | |
|---|---|---|
| EP | A-518720 | 12/1992 |
| EP | A-694059 | 1/1999 |
| GB | A-2244258 | 11/1991 |
| GB | 2374581 A | 10/2002 |
| GB | 2375515 A | 11/2002 |
| WO | WO 89/12587 | 12/1989 |
| WO | WO 92/17382 | 10/1992 |

(Continued)

OTHER PUBLICATIONS

International Search Report dated Oct. 29, 2003 for Application No. PCT/GB03/03427.

(Continued)

*Primary Examiner*—Stephen Castellano
(74) *Attorney, Agent, or Firm*—Norris McLaughlin & Marcus, PA

(57) ABSTRACT

A water-soluble container comprising a first compartment containing a first composition, a second compartment containing a second composition and a rigid spacer located in the first compartment and/or the second compartment, such that a wall or wall section of the first and/or second compartment is prevented from contacting a wall or wall section of the other compartment.

17 Claims, 1 Drawing Sheet

FOREIGN PATENT DOCUMENTS

Figure 1:
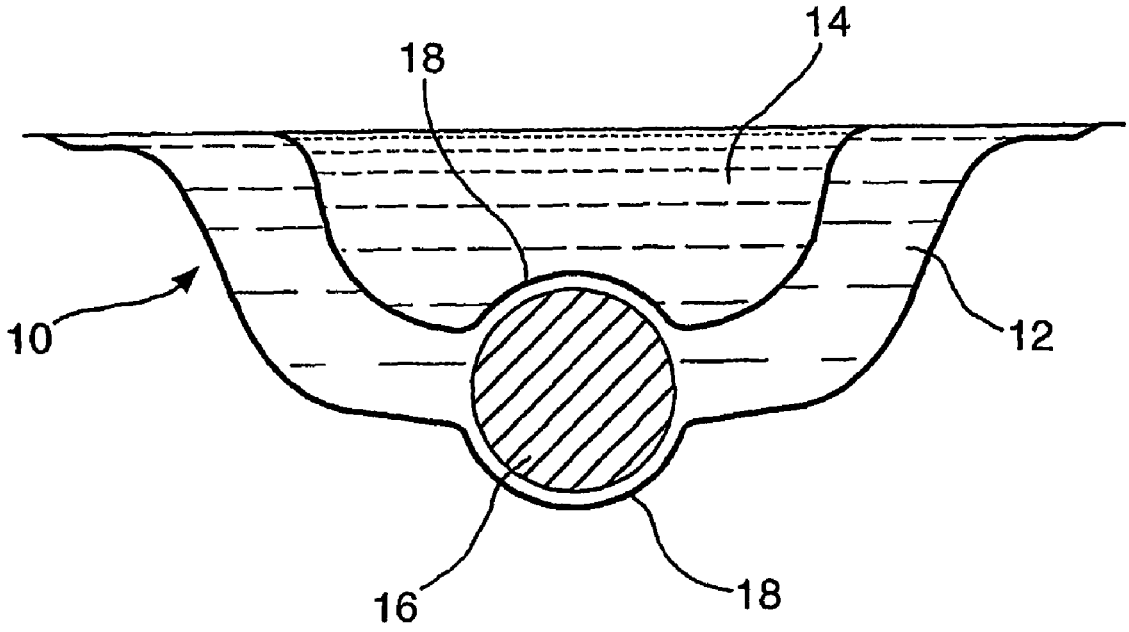

| | | |
|---|---|---|
| WO | WO 93 08095 A | 4/1993 |
| WO | WO 99/06522 | 2/1999 |
| WO | WO 00/55045 | 9/2000 |
| WO | WO 01/85898 | 11/2001 |
| WO | WO 02/16222 | 2/2002 |
| WO | WO 02 053696 A | 7/2002 |
| WO | WO 03 072694 A | 9/2003 |

OTHER PUBLICATIONS

International Preliminary Examination Report dated Aug. 20, 2004 for Application No. PCT/GB03/03427.
Combined Search and Examination Report from The Patent Office in Great Britain dated Dec. 13, 2002 for Application No. GB 0218375.4.
Kirk Othmer's *Encyclopedia of Chemical Technology*, 3rd Ed., vol. 22, pp. 360-379, "Surfactants and Detersive Systems".

* cited by examiner

WATER SOLUBLE CONTAINER WITH RIGID SPACER

The present invention relates to a water-soluble container and to a process for the preparation of such a container.

It is known to package chemical compositions, particularly those that may be of a hazardous or irritant nature, in films, particularly water-soluble films. Such containers can simply be added to water in order to dissolve or disperse the contents of the container into the water.

For example, WO 89/12587 discloses a package, which comprises an envelope of a water-soluble material, which comprises a flexible wall and a water-soluble heat seal. The package may contain an organic liquid comprising, for example, a pesticide, fungicide, insecticide or herbicide.

WO 92/17382 discloses a package containing an agrochemical comprising a first sheet of non-planar water-soluble or water-dispersible material and a second sheet of water-soluble or water-dispersible material superposed on the first sheet and sealed to it.

WO 01/85898 discloses a two-compartment water-soluble package in which an open compartment is sealed with a pre-sealed compartment.

A new water-soluble container has now been developed.

According to the present invention, there is provided a water-soluble container comprising a first compartment containing a first composition, a second compartment containing a second composition and a rigid spacer located in the first compartment and/or the second compartment, such that a wall or wall section of the first and/or second compartment is prevented from contacting a wall or wall section of the other compartment.

The term "water-soluble" is taken to include water dispersible.

The rigid spacer is positioned in the first compartment and/or the second compartment such that a wall or wall section of the first compartment and/or the second compartment is prevented from contacting a wall or wall section of the other compartment.

This may be advantageous in a number of situations. For example, one of the compartments may contain solid particles having sharp edges that may pierce or cut through a wall or wall section of the compartment in which they are contained. To prevent these particles from damaging a wall or wall section of the other compartment, a rigid spacer may be employed to reduce or prevent contact between the two compartments.

The spacer may also be advantageous where the first compartment or the second compartment is only partially filled. For example, where the first compartment is only partially filled, the spacer may be located in the first compartment to prevent the first compartment from collapsing. Similarly, where the second compartment is only partially filled, the spacer may be located in the second compartment to prevent the second compartment from collapsing. In situations where the content of one of the compartments expands during storage, the spacer may be employed to prevent the expanded contents of that compartment from displacing the contents of the other compartment.

The spacer may also be advantageous when one of the compositions is susceptible to degradation by one or more components of the atmosphere (e.g. water vapour or oxygen). Such components may diffuse into the interior of the container, through the container walls. For example, where the second composition is moisture-sensitive, the second compartment may be at least partially enclosed by the first compartment, so that the second composition is at least partially shielded from direct contact with moisture permeating into the container through the walls of the first compartment from the surrounding atmosphere. By positioning the spacer, for example, in the first compartment such that a wall or a wall section of the first compartment is prevented from contacting a wall or wall section of the second compartment, the risk of a component of the atmosphere permeating directly through a wall or wall section of the first compartment and through a wall or wall section of the second compartment is reduced, if not eliminated. The spacer itself may also assist in shielding the second composition from a component of the atmosphere permeating through the container.

Where the second compartment is at least partially enclosed by the first compartment, more than 30%, preferably more than 50%, of the outer surface area of the second compartment may be enclosed by the first compartment. Preferably, more than 60%, for example, 70 to 100%, especially 80 to 90% of the surface area of the second compartment is enclosed by the first compartment. The container of the present invention may comprise only the first and second compartments, or may comprise one or more further compartments. The further compartments may also be partly or fully enclosed by the first compartment if desired.

The second composition may be capable of generating a gas upon degradation. For instance, the second composition may generate a gas upon coming into contact with, for example, water, oxygen, light or elevated temperatures. The gas may be any gas, but is usually one or more of $O_2$, $CO_2$, $N_2$, $Cl_2$, HCl or the volatile ingredients of a fragrance.

The container may be provided with a gas release means. The gas release means may take any form that allows the escape of gas generated inside one or more of the compartments of the container. In particular, the first compartment and/or the second compartment may comprise a gas release means. A gas release means may be present in the first compartment, especially where this compartment is not shielded from the atmosphere. A gas release means may be present in the second compartment to assist further in preventing the accumulation of gas in the compartment.

The gas release means may take the form of a vent. A vent may comprise a one-way valve, for example, one or more holes covered with one or more flaps. Most preferably, however, the vent is simply one or more holes. A single hole may be provided, although an array, either regular or irregular, may also be provided. Suitably, the hole or holes each have a maximum dimension of 0.1 to 2 mm. The maximum dimension is the diameter of the hole if the hole is circular.

Preferably the hole or holes have a maximum dimension of 0.2 to 1.5 mm, especially about 0.5 to 1 mm, more especially about 0.8 mm.

The vent may be provided simply by forming a hole or holes in the container, for example by use of a needle. Other means such as a laser, a strong gas beam or a projectile such as a particle may also be used. The hole or holes are generally provided after the container has been formed, although it may also be provided earlier in the process if desired. It is also possible to include a hole or holes at the time of forming the container, for example, by providing a mould with means of an appropriate shape to form the hole or holes at the same time that the container is formed.

The gas release means may also, for example, comprise a permeable wall or wall section of the container. An example is a permeable wall or wall section that has microchannels therein. Such microchannels can be formed by any means. For example, the microchannels may be provided by including particles in the wall or wall section. Suitable particles are polyethylene, polypropylene or starch particles. Preferably, the particles are water-soluble. These particles may be included in the polymer composition, for example, by using a bi-injection moulding process. In general, the particles have a diameter of at least the wall thickness. The amount of particles included should be such that agglomerates form.

Another possible way of providing the container with gas release means is to form at least part of the container with a polymer that is inherently gas permeable. It is, of course, necessary that the polymer is permeable to the gas being generated inside the container. An example of such a polymer is a cellulose derivative.

A further possibility is to generate a gas pressure sensitive membrane, for example comprising areas of weakness in the container designed to open as the gas pressure rises in the container. Areas of weakness can easily be generated by, for example, pressing a dimpled stamp onto the surface.

If a gas release means is present, it should be such that it does not allow any of the liquid or solid contents of the container to leak out until the container is dissolved in water.

The spacer may take the form of any rigid solid. Preferably, however, the outer surface of the spacer is smooth, and is devoid of any sharp edges or protrusions. The spacer may be in the form of a pill, a disc or a tablet. In one embodiment, the spacer is substantially spherical in shape.

The spacer may be a solid composition, or may take the form of a housing, which is filled at least in part with a composition. The composition may be a gas, solid or liquid. Preferably, the composition is a particulate solid, or a gelled or thickened liquid. The composition of or contained in the spacer may be selected to work in combination with the first and/or second composition. For example, where the first and/or second composition is a detergent, the composition of or contained in the spacer may be a bleach, stain remover, water-softener, enzyme or fabric conditioner. Preferably, the composition contained in the spacer is an enzyme.

Where the spacer is in the form of a housing containing a composition, the housing may be formed of any suitable material. Preferably, however, the housing is formed of a water-soluble material. This material may be formed into the housing using any suitable technique, for example, by thermoforming or injection moulding. Preferably, however, the housing is formed by coating, for example, spray coating the composition with a material that solidifies, for example, by drying or setting, to form the housing. Suitable coating materials include poly(vinyl alcohol) (PVOH), cellulose derivatives such as hydroxypropyl methyl cellulose (HPMC) and gelatin. Preferably, HPMC is employed. Spray coating is useful for enclosing a relatively small volume of solid. For example, where the solid is in the form of a sphere (e.g. formed of compressed particulate material), the sphere may have a diameter of 5 to 30 mm, preferably, 8 to 13 mm. It may be difficult to enclose a solid having such small dimensions using a thermoformed sheet of material, without creating unacceptably large seal areas.

The thickness of the coating is preferably 10 to 500 μm, more preferably, 20 to 300 μm, especially, 50 to 160 μm, more especially, 100 to 150 μm most especially, 120 to 1550 μm.

The spacer, for example, may measure 2 to 30 mm its longest in dimension, preferably, 4 to 10 mm in dimension. For example, where the spacer is spherical, the diameter of the spacer may be 2 to 20 mm, preferably, 4 to 10 mm. The volume of the spacer may be, for example, 265 to 4200 $mm^3$. It will be understood that the size of the spacer may vary depending on the size and geometry of the container and/or each of its respective compartments.

The container may contain one or more spacer, for example, two, three or four spacers. The spacers may be the same or different. For example, where two spacers are employed, each spacer may contain a different composition.

The container of the present invention can have an attractive appearance because it contains a first composition and a second composition, which are advantageously held in a fixed position in relation to each other. The compositions can be easily differentiated to accentuate their difference. For example, the compositions may be coloured differently, or may be in a different physical state. In one embodiment, the first composition is a liquid or gel, while the second composition is a solid or semi-solid. Thus, for example, the container can have an appearance of a fried egg or eyeball. The use of the spacer may also enhance the aesthetic appearance of the container.

The container may contain two compositions that are incompatible with each other. It may also contain a composition that is incompatible with the part of the container enclosing the other composition.

In one embodiment, the one or more second compartments are fully enclosed by the first compartment. For example, the second composition may be enclosed in a second compartment formed of, for example, a film of a water-soluble polymer. The second compartment may then be placed in a container (first compartment) containing the first composition. Thus, the second compartment may be regarded as an inner compartment within an outer compartment (first compartment) defined by the container. Both the outer compartment and inner compartments may each be provided with gas release means, such as the ones herein described. Alternatively, only one of the inner and outer compartments is provided with a gas release means. The spacer is located in the inner compartment and/or the outer compartment to prevent at least a wall or wall section of the inner and/or the outer compartment from touching a wall or wall section of the other compartment. Preferably, the spacer is located in the outer compartment to prevent a wall or wall section of the outer compartment the container from contacting a corresponding wall or wall section of the inner compartment of the container.

The second compartment may be fixed to the first compartment, or may be free. Such containers can be produced by any method, for example, by forming the outer compartment, filling it with the desired composition and the pre-prepared inner compartment, and then sealing the outer compartment. The outer compartment and the inner compartment can be produced by any method. Examples of suitable methods by which each compartment may be independently prepared are vertical form fill sealing, thermoforming and injection moulding.

In an alternative embodiment, the container comprises a first compartment containing the first composition, and a sealing member that is employed to seal the first composition in the first compartment, as illustrated in WO 01/85898, although care will need to be taken to ensure that the compartments have the special relationship herein defined. The sealing member preferably comprises a second compartment for the second composition. For example, the second compartment may take the form of a housing attached to the underside of the sealing member. When the sealing member is positioned over the first compartment, the housing is located within the first compartment. The housing may share at least one wall section or wall in common with the sealing member. The remaining walls or wall sections of the housing may be surrounded by the first composition in the first compartment. Preferably, from 50 to 90%, more preferably, from 60 to 80% of the surface area of the housing is enclosed by the first compartment. In this embodiment, the sealing member may be provided with a gas release means, for example, one of the means herein described.

Preferably, the first compartment and/or the second compartment comprises means for retaining the spacer in position. For example, the spacer may be held in place using an adhesive or mechanical means. In a preferred embodiment, a wall or wall section of the first compartment is provided with a recess, which retains the spacer in position. Alternatively or additionally, a wall or wall section of the second compartment may be provided with a recess or other means for retaining the spacer in position.

The container of the present invention may have more than two compartments, for example, three, four, five or six compartments. In one embodiment, the first compartment is divided into two or more sub-compartments, for example, three or four compartments. Each of these compartments may contain a different composition. Alternatively, some or all of the compartments may contain the same composition. The second compartment may also be divided into a number of sub-compartments, for example, two, three, four or five sub-compartments. Each of these compartments may contain a different composition. Alternatively, some or all of the compartments may contain the same composition. Each of the compartments may be formed using any suitable material. For example, any one of the materials herein described may be employed.

It is possible to ensure that one of the compositions is released at a different time to the other(s). For instance, one composition can be released immediately the container is added to water, whereas the other may be released later. This may be achieved by having a compartment that takes longer to dissolve surrounding one of the compositions. This may be achieved, for example, by having different compartment wall thicknesses. It may also be achieved by choosing compartment walls that dissolve at different temperatures, for example the different temperatures encountered during the cycle of a laundry or dish washing machine. The spacer may also improve the reliability of the sequential release of the compositions contained in the container. In cases where the rigid spacer contains an active composition, this composition may also be released at the same or different time to the other compositions contained in the container.

In one embodiment, the first compartment is of, for example, a moulded composition, especially one produced by injection moulding or blow moulding. The first compartment may have a wall thickness of, for example, greater than 100 μm, for example greater than 150 μm or greater than 200 μm, 300 μm, 500 μm, 750 μm or 1 mm. Preferably, the wall thickness is from 200 to 400 82 m.

The first compartment may also, for example, be formed of a film. The film may be a single film, or a laminated film as disclosed in GB-A-2,244,258. While a single film may have pinholes, the two or more layers in a laminate are unlikely to have pinholes that coincide.

The film may be produced by any process, for example by extrusion and blowing or by casting. The film may be unoriented, monoaxially oriented or biaxially oriented. If the layers in the film are oriented, they usually have the same orientation, although their planes of orientation may be different if desired.

The layers in a laminate may be the same or different. Thus they may each comprise the same polymer or a different polymer.

Examples of water-soluble polymers which may be used in a single layer film or in one or more layers of a laminate or which may be used for injection moulding or blow moulding are poly(vinyl alcohol) (PVOH), cellulose derivatives such as hydroxypropyl methyl cellulose (HPMC) and gelatin. An example of a preferred PVOH is ethoxylated PVOH. The PVOH may be partially or fully alcoholised or hydrolysed. For example it may be from 40 to 100%, preferably from 70 to 92%, more preferably about 88% or about 92%, alcoholised or hydrolysed. The degree of hydrolysis is known to influence the temperature at which the PVOH starts to dissolve in water. 88% hydrolysis corresponds to a film soluble in cold (ie room temperature) water, whereas 92% hydrolysis corresponds to a film soluble in warm water.

The thickness of the film used to produce the container, is preferably 40 to 300 μm, more preferably 80 to 200 μm, especially 100 to 160 μm, more especially 100 to 150 μm and most especially 120 to 150 μm.

In one embodiment, the film is vacuum formed or thermoformed into a first compartment or pocket for the first composition. For example, in a thermoforming process the film may be drawn down or blown down into a mould. Thus, for example, the film is heated to the thermoforming temperature using a thermoforming heater plate assembly, and then drawn down under vacuum or blown down under pressure into the mould. Plug-assisted thermoforming and pre-stretching the film, for example by blowing the film away from the mould before thermoforming, may, if desired, be used. One skilled in the art can choose an appropriate temperature, pressure or vacuum and dwell time to achieve an appropriate shape. The amount of vacuum or pressure and the thermoforming temperature used depend on the thickness of the film and on the polymer or mixture of polymers being used. Thermoforming of PVOH films is known and described in, for example, WO 00/55045 and WO 01/85898.

In a preferred embodiment, the mould employed in the thermoforming process is provided with a recess for receiving a spacer. Thus, when a film to be moulded is placed within the mould and moulded, the film will comprise a recess for the spacer. This film may be moulded to form a compartment or "pocket" for the first composition. The spacer may be positioned in the moulded film, for example, while the film is still warm, such that it can be held in position. In certain embodiments, an adhesive or mechanical means may also be employed to secure the spacer in position.

A suitable forming temperature for PVOH or ethoxylated PVOH is, for example, from 90 to 130° C., especially 90 to 120° C. A suitable forming pressure is, for example, 69 to 138 kPa (10 to 20 p.s.i.), especially 83 to 117 kPa (12 to 17 p.s.i.). A suitable forming vacuum is 0 to 4 kPa (0 to 40 mbar), especially 0 to 2 kPa (0 to 20 mbar). A suitable dwell time is, for example, 0.4 to 2.5 seconds, especially 2 to 2.5 seconds.

While desirably conditions chosen within the above ranges, it is possible to use one or more of these parameters outside the above ranges, although it may be necessary to compensate by changing the values of the other two parameters.

Once formed, the pocket may be filled with the first composition. The pocket may be completely filled or only partially filled. The composition may be a solid. For example, it may be a particulate or granulated solid, or a tablet. Preferably, however, the first composition is a liquid, which may be thickened or gelled, if desired. More preferably, the first composition is a transparent liquid, especially, a coloured, transparent liquid. The liquid composition may be non-aqueous or aqueous. Preferably, the composition comprises less than or more than 5% total or free water.

The term "free water" is defined in WO 02/16222, which is incorporated herein by reference. There is no direct correlation between the actual amount of water present in a composition and the amount of free water as required in the present invention. Free water does not includes water which is not available to the surrounding compartment such as water held within a gelled matrix or water of salvation of any components present in the composition. Thus, the actual amount of water present in the composition may be in excess of the amount of free water. For example, the actual amount of water in the composition may be more than 5, 10, 15, 20, 25 or 30 wt %. The total water content may be less than 80 wt %, for example, less than 70, 60, 50, 40 wt %.

In order to determine the amount of free water present in a composition, a standard loss-on-drying determination test may be carried out. A sample of the composition, usually about 10 g, is weighed, and then maintained at 60° C. for 3 hours under a partial vacuum of 200 mbar (20 kPa). The sample is then re-weighed, and the weight lost determined. In the present invention, the loss on drying the first composition must be less than 5 wt %, preferably less than 4, 3, 2 or 1 wt %. Even more preferably the first composition is anhydrous. The first composition may be a solid or a liquid.

The first composition may have more than one phase. For example it may comprise an aqueous composition and a liquid composition that is immiscible with the aqueous composition. It may also comprise a liquid composition and a separate solid composition, for example in the form of a ball, pill or speckles.

The first composition may be any composition that is intended to be released in an aqueous environment. Thus, for example, it may be an agrochemical composition such as a plant protection agent, for instance a pesticide such as an insecticide, fungicide, herbicide, acaricide, or nematocide, a plant growth regulator or a plant nutrient. Such compositions are generally packaged in amounts of from 0.1 g to 7 kg, preferably 1 to 5 kg, when in solid form. When in liquid or gelled form, such compositions are generally packaged in amounts of from 1 ml to 10 litres, preferably 0.1 to 6 litres, especially from 0.5 to 1.5 litres.

The first composition may also be a fabric care, surface care or dishwashing composition. Thus, for example, it may be a dishwashing, water-softening, laundry or detergent composition, or a rinse aid. Such compositions may be suitable for use in a domestic washing machine. The composition may also be a disinfectant, antibacterial or antiseptic composition, or a refill composition for a trigger-type spray. Such compositions are generally packaged in amounts of from 5 to 100 g, especially from 15 to 40 g. For example, a dishwashing composition may weigh from 15 to 30 g, a water-softening composition may weigh from 15 to 40 g. Preferably, the first composition is a detergent composition for laundry.

The first composition, if in liquid form, may be anhydrous. Alternatively, the first composition may comprise water, preferably, in an amount of from 0 to 10 wt %, more preferably, from 0 to 5 wt %, and especially, from 0 to 2 wt The remaining ingredients of the first composition depend on the use of the composition. Thus, for example, the composition may contain surface-active agents such as an anionic, nonionic, cationic, amphoteric or zwitterionic surface-active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols.

Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_3(CH_2)_n(CHOSO_3^-M^+)\,(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_3(CH_2)_x(CHOSO_3^-M^+)CH_3 \text{ and}$$

$$CH_3(CH_2)_x(CHOSO_3^-M^+)\,CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$-$C_{18}$ fatty acids, especially the sodium or potassium salts, and alkyl, for example $C_8$-$C_{18}$, benzene sulfonates.

Examples of nonionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$ for example $C_{10}$-$C_{14}$, alkyl group and n is at least 1, for example from 1 to 16, preferably 2 to 12, more preferably 3 to 10.

The alkoxylated fatty alcohol nonionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated nonionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further nonionic surfactants are, for example, $C_{10}$-$C_{18}$ alkyl polyglycosides, such s $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$ N-(3-methoxypropyl) glycamides and ethylene oxide-propylene oxide block polymers of the Pluronic type.

Examples of cationic surfactants are those of the quaternary ammonium type.

The total content of surfactants in the composition is desirably 60 to 95 wt %, especially 75 to 90 wt %. Desirably an anionic surfactant is present in an amount of 50 to 75 wt %, the nonionic surfactant is present in an amount of 5 to 50 wt %, and/or the cationic surfactant is present in an amount of from 0 to 20 wt %. The amounts are based on the total solids content of the composition, i.e. excluding any solvent which may be present.

The compositions, particularly when used as laundry washing or dishwashing compositions, may also independently comprise enzymes, such as protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. Desirably the enzymes are independently present in the compositions in an amount of from 0.5 to 3 wt %, especially 1 to 2 wt %, when added as commercial preparations they are not pure and this represents an equivalent amount of 0.005 to 0.5 wt % of pure enzyme.

The compositions may, if desired, independently comprise a thickening agent or gelling agent. Suitable thickeners are polyacrylate polymers such as those sold under the trade mark CARBOPOL, or the trade mark ACUSOL by Rohm and Haas Company. Other suitable thickeners are xanthan gums. The thickener, if present, is generally present in an amount of from 0.2 to 4 wt %, especially 0.5 to 2 wt %.

Compositions used in dishwashing independently usually comprise a detergency builder. The builders counteract the effects of calcium, or other ion, water hardness. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those sold by Monsanto under the trade mark Dequest and alkylhydroxy phosphonates. Citrate salts and $C_{12}$-$C_{18}$ fatty acid soaps are preferred. Further builders are; phosphates such as sodium, potassium or ammonium salts of mono-, di- or tripoly or oligo-phosphates; zeolites; silicates, amorphous or structured, such as sodium, potassium or ammonium salts.

Other suitable builders are polymers and copolymers known to have builder properties. For example, such materials include appropriate polyacrylic acid, polymaleic acid, and polyacrylic/polymaleic and copolymers and their salts, such as those sold by BASF under the trade mark Sokalan. The builder is desirably present in an amount of up to 90 wt %, preferably 15 to 90 wt %, more preferable 15 to 75 wt %, relative to the total weight of the composition. Further details of suitable components are given in, for example, EP-A-694,059, EP-A-518,720 and WO 99/06522.

The compositions can also optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners, and perfumes. If used, such optional ingredients will generally constitute no more than 10 wt %, for example from 1 to 6 wt %, the total weight of the compositions.

Compositions which comprise an enzyme may optionally contain materials which maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.1 to 1 wt % of the compositions.

The compositions may optionally comprise materials which serve as phase stabilizers and/or co-solvents. Examples are $C_1$-$C_3$ alcohols such as methanol, ethanol and propanol. $C_1$-$C_3$ alkanolamines such as mono-, di- and triethanolamines can also be used, by themselves or in combination with the alcohols. The phase stabilizers and/or co-solvents can, for example, constitute 0 to 1 wt %, preferably 0.1 to 0.5 wt %, of the composition.

The compositions may optionally comprise components which adjust or maintain the pH of the compositions at optimum levels. The pH may be from, for example, 1 to 13, such as 8 to 11 depending on the nature of the composition. For example a dishwashing composition desirably has a pH of 8 to 11, a laundry composition desirable has a pH of 7 to 9, and a water-softening composition desirably has a pH of 7 to 9. Examples of pH adjusting agents are NaOH and citric acid.

The above examples may be used for dish or fabric washing. In particular dish washing formulations are preferred which are adapted to be used in automatic dish washing machines. Due to their specific requirements specialised formulation is required and these are illustrated below Amounts of the ingredients can vary within wide ranges, however preferred automatic dishwashing detergent compositions herein (which typically have a 1% aqueous solution pH of above 8, more preferably from 9.5 to 12, most preferably from 9.5 to 10.5) are those wherein there is present: from 5% to 90%, preferably from 5% to 75%, of builder; from 0.1% to 40%, preferably from 0.5% to 30%, of bleaching agent; from 0.1% to 15%, preferably from 0.2% to 10%, of the surfactant system; from 0.0001% to 1%, preferably from 0.001% to 0.05%, of a metal-containing bleach catalyst; and from 0.1% to 40%, preferably from 0.1% to 20% of a water-soluble silicate. Such fully-formulated embodiments typically further comprise from 0.1% to 15% of a polymeric dispersant, from 0.01% to 10% of a chelant, and from 0.00001% to 10% of a detersive enzyme, though further additional or adjunct ingredients may be present. Detergent compositions herein in granular form typically limit water content, for example to less than 7% free water, for better storage stability.

Non-ionic surfactants useful in ADW (Automatic Dish Washing) compositions of the present invention desirably include surfactant(s) at levels of from 2% to 60% of the composition. In general, bleach-stable surfactants are preferred. Non-ionic surfactants generally are well known, being described in more detail in Kirk Othmer's Encyclopedia of Chemical Technology, 3rd Ed., Vol. 22, pp. 360-379, "Surfactants and Detersive Systems", incorporated by reference herein.

Preferably the ADW composition comprises at least one non-ionic surfactant. One class of non-ionics are ethoxylated non-ionic surfactants prepared by the reaction of a monohydroxy alkanol or alkylphenol with 6 to 20 carbon atoms with preferably at least 12 moles particularly preferred at least 16 moles, and still more preferred at least 20 moles of ethylene oxide per mole of alcohol or alkylphenol.

Particularly preferred non-ionic surfactants are the non-ionic from a linear chain fatty alcohol with 16-20 carbon atoms and at least 12 moles particularly preferred at least 16 and still more preferred at least 20 moles of ethylene oxide per mole of alcohol.

According to one preferred embodiment the non-ionic surfactant additionally comprise propylene oxide units in the molecule. Preferably this PO units constitute up to 25% by weight, preferably up to 20% by weight and still more preferably up to 15% by weight of the overall molecular weight of the non-ionic surfactant. Particularly preferred surfactants are ethoxylated mono-hydroxy alkanols or alkylphenols, which additionally comprises polyoxyethylene-polyoxypropylene block copolymer units. The alcohol or alkylphenol portion of such surfactants constitutes more than 30%, preferably more than 50%, more preferably more than 70% by weight of the overall molecular weight of the non-ionic surfactant.

Another class of non-ionic surfactants includes reverse block copolymers of polyoxyethylene and polyoxypropylene and block copolymers of polyoxyethylene and polyoxypropylene initiated with trimethylolpropane.

Another preferred non-ionic surfactant can be described by the formula:

$$R^1O[CH_2CH(CH_3)O]_x[CH_2CH_2O]_y[CH_2CH(OH)R^2]$$

wherein $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

wherein $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group , x is a value between 1 and 30 and, k and j are values between 1 and 12, preferably between 1 and 5. When the value of x is $\geqq 2$ each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3$ H, methyl or ethyl are particularly preferred. Particularly preferred values for x are comprised between 1 and 20, preferably between 6 and 15.

As described above, in case $x \geqq 2$, each $R^3$ in the formula can be different. For instance, when x=3, the group $R^3$ could be chosen to build ethylene oxide ($R^3$=H) or propylene oxide ($R^3$=methyl) units which can be used in every single order for instance (PO) (EO) (EO), (EO) (PO) (EO), (EO) (EO) (PO), (EO)(EO)(EO), (PO)(EO)(PO), (PO) (PO) (EO) and (PO) (PO) (PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different non-ionic surfactants is particularly preferred in ADW formulations for example mixtures of alkoxylated alcohols and hydroxy group containing alkoxylated alcohols.

The second composition may be or include components that are the same as the first composition. In one embodiment, the second composition may be composition that is capable of generating a gas, for example, upon coming into contact with moisture. This generation need not be instantaneous. For example, the composition may only generate a gas gradually or over an extended period, for example, several weeks or months, or even up to a year.

Preferably, the second composition comprises a moisture-sensitive component. For example, the second composition may be or may contain bleach. Examples of bleaches are, for example, listed in WO 99/06522. These include oxygen releasing bleaching agent such as a hydrogen peroxide source and an organic peroxyacid bleach precursor compound or a preformed organic peroxyacid. Examples of hydrogen peroxide sources are inorganic perhydrate bleaches such as the alkali metal salts of perborate, percarbonate, perphosphate, persulfate and persilicates. Examples of organic peroxyacid bleach precursors are listed in WO 99/06522. The bleaches also include chlorine based agents such as hydantoins, for example 1,3-dichloro-5,5-dimethyl hydantoin, hypochlorites such as sodium hypochlorite or dichloroisocyanurates such as sodium dichloroisocyanurate.

As noted above, some of the components in the second composition may be the same as some of the components in the first composition. Preferably, however, the first composition is devoid of moisture-sensitive components, such as bleach.

The second composition may be a solid or a liquid. Preferably, the second composition is a compressed solid or a particulate solid.

The second composition is contained in a second compartment. In one embodiment, the second compartment is defined by a housing formed of a water-soluble polymer, such as one of the polymers mentioned herein. The housing may be formed using any of the methods described herein, including, for example, thermoforming and injection moulding. The second compartment may be placed in the first compartment, before the first compartment is sealed. The spacer is positioned in the first and/or second compartments to prevent at least a wall or wall section of the compartments from touching.

The second composition may alternatively be included in a sealing member, which is placed on top of the pocket and sealed thereto. It is also possible for a previously prepared container containing the second composition to be adhered to the sealing member. For example, a sealing member in the form of a film may have a partially or completely filled compartment containing a composition attached thereto. The second composition or compartment may be held on the under side of the sealing member, such that when the sealing member is positioned over the pocket, the second compartment extends inside the first compartment. In a preferred embodiment, the first compartment is only partially filled before the sealing member is placed over it. However, once the sealing member is placed over the first compartment, the first compartment appears to be full, because of the volume occupied by the second compartment. The spacer is preferably placed in the first compartment, for example, prior to sealing the first compartment with the sealing member. The spacer should be of a sufficient size to prevent a wall or wall section of the first compartment from touching at least a wall or wall section of the second compartment once the container is suitably filled. In one embodiment, the underside of the sealing member is provided with the second compartment containing the second composition. This is especially appropriate when the sealing member is flexible, for example in the form of a film. When the sealing member is placed over the first compartment, the housing is positioned within the first compartment. Thus, any composition contained within the housing may be at least partially enclosed by the first composition in the first compartment. It may be possible to fill the housing with the second composition before or after the sealing member is placed over the first compartment. Preferably, the housing is filled before the first compartment is sealed with the sealing member. The spacer is preferably placed in the first compartment, for example, prior to sealing the first compartment with the sealing member. The spacer should be of a sufficient size to prevent a wall or wall section of the housing from touching at least a wall or wall section of the first compartment once the container is suitably filled.

The sealing member may be placed on top of the pocket and sealed thereto. For example, the sealing member in the form of a film may be placed over a filled pocket and across the sealing portion, if present, and the films sealed together at the sealing portion. In general, there is only one compartment or composition in or on the sealing member, but it is possible to have more than one compartment or composition if desired, for example 2 or 3 compartments or compositions.

The second compartment may be formed by any technique. For example it can be formed by vertical form fill sealing the second composition within a film, such as by the process described in WO 89/12587. It can also be formed by having an appropriate shape for an injection moulding.

However, it is preferred to use a vacuum forming or thermoforming techniques, such as that previously described in relation to the first compartment of the container of the present invention. Thus, for example, a pocket surrounded by a sealing portion is formed in a film, the pocket is filled with the second composition, a film is placed on top of the filled pocket and across the sealing portion and the films are sealed together at the sealing portion. In general, however, the film placed on top of the filled pocket to form the second compartment does not itself comprise a further compartment.

Further details of this thermoforming process are generally the same as those given above in relation to the first compartment of the container of the present invention. All of the above details are incorporated by reference to the second compartment, with the following differences:

The second compartment is smaller than the first compartment. In general the first compartment and the second compartment (or composition if not held within a compartment) have a volume ratio of from 2:1 to 20:1, preferable 4:1 to 10:1. Generally the second compartment does not extend across the sealing portion.

The thickness of the film comprising the second compartment may also be less than the thickness of the film making up the first compartment of the container of the present invention, because the film is not subjected to as much localised stretching in the thermoforming step. It is also desirable to have a thickness which is less than that of the film used to form the first compartment to ensure a sufficient heat transfer through the film to soften the base web if heat sealing is used.

The thickness of the covering film is generally from 20 to 160 μm, preferably from 40 to 100 μm, such as 40 to 80 μm or 50 to 60 μm.

This film may be a single-layered film but is desirably laminated to reduce the possibility of pinholes allowing leakage through the film. The film may be the same or different as the film forming the first compartment. If two or more films are used to form the film comprising the second compartment, the films may be the same or different. Examples of suitable films are those given for the film forming the first compartment.

The first compartment and the sealing member may be sealed together by any suitable means, for example by means of an adhesive or by heat sealing. Mechanical means is particularly appropriate if both have been prepared by injection moulding. Other methods of sealing include infra-red, radio frequency, ultrasonic, laser, solvent, vibration and spin welding. An adhesive such as an aqueous solution of PVOH may also be used. The seal desirably is water-soluble if the containers are water-soluble.

If heat sealing is used, a suitable sealing temperature is, for example, 120 to 195° C., for example 140 to 150° C. A suitable sealing pressure is, for example, from 250 to 600 kPa. Examples of sealing pressures are 276 to 552 kPa (40 to 80 p.s.i.), especially 345 to 483 kPa (50 to 70 p.s.i.) or 400 to 800 kPa (4 to 8 bar), especially 500 to 700 kPa (5 to 7 bar) depending on the heat sealing machine used. Suitable sealing dwell times are 0.4 to 2.5 seconds.

One skilled in the art can use an appropriate temperature, pressure and dwell time to achieve a seal of the desired integrity. While desirably conditions are chosen within the above ranges, it is possible to use one or more of these parameters outside the above ranges, although it would be necessary to compensate by changing the values of the other two parameters.

In an embodiment of the invention, the sealing member does not comprise the second composition at the time it is placed on top of the first component. Instead the second composition is added afterwards. Thus, for example, it is possible for the sealing member to contain a housing, which is filled, either before or after sealing, by a liquid composition that is allowed to gel in-situ.

If more than one container is formed at the same time from the same sheet, the containers may then be separated from each other, for example by cutting the sealing portions, or flanges. Alternatively, they may be left conjoined and, for example, perforations provided between the individual containers so that they can be easily separated a later stage, for example by a consumer. If the containers are separated, the flanges may be left in place. However, desirably the flanges are partially removed in order to provide an even more attractive appearance. Generally the flanges remaining should be as small as possible for aesthetic purposes while bearing in mind that some flange is required to ensure the two films remain adhered to each other. A flange having a width of 1 mm to 8 mm is desirable, preferably 2 mm to 7 mm, most preferably about 5 mm.

The containers may themselves be packaged in outer containers if desired, for example non-water soluble containers which are removed before the water-soluble containers are used.

The containers produced by the process of the present invention, especially when used for a fabric care, surface care or dishwashing composition, may have a maximum dimension of 5 cm, excluding any flanges. For example, a container may have a length of 1 to 5 cm, especially 3.5 to 4.5 cm, a width of 1.5 to 3.5 cm, especially 2 to 3 cm, and a height of 1 to 2 cm, especially 1.25 to 1.75 cm.

The primary composition and the secondary composition may be appropriately chosen depending on the desired use of the container.

If the container is for use in laundry washing, the first composition may comprise, for example, a detergent, and the second composition may comprise a bleach, stain remover, water-softener, enzyme or fabric conditioner. The article may be adapted to release the compositions at different times during the laundry wash. For example, a bleach or fabric conditioner is generally released at the end of a wash, and a water-softener is generally released at the start of a wash. An enzyme may be released at the start or the end of a wash.

If the container is for use as a fabric conditioner, the first composition may comprise a fabric conditioner and the second composition may comprise an enzyme which is released before or after the fabric conditioner in a rinse cycle.

If the container is for use in dish washing the first composition may comprise a detergent and the second composition may comprise a water-softener, salt, enzyme, rinse aid, bleach or bleach activator. The article may be adapted to release the compositions at different times during the laundry wash. For example, a rinse aid, bleach or bleach activator is generally released at the end of a wash, and a water-softener, salt or enzyme is generally released at the start of a wash.

Preferably, the container is for use in laundry washing.

The containers of the present invention will now be further described with reference to FIG. 1. This illustrates an example of a container which can be produced.

FIG. 1 depicts a water-soluble container 10 comprising a first compartment 12, a second compartment 14, and a spacer 16. The spacer 16 is located in the first compartment 12, and retained in position between the walls of the first and second compartments 12, 14 by corresponding recesses 18 in the first compartment 12, and a second compartment 14. The spacer 16 keeps the walls of the first compartment 12 and second compartment 14 from touching.

The first compartment 12 contains an anhydrous laundry detergent composition. The second compartment 14 contains bleach. The spacer 16 contains an enzyme, and is surrounded by a coating of a water-soluble polymer.

The invention claimed is:

1. A water-soluble container comprising a first compartment containing a first composition and sealed with a sealing member, said sealing member comprising a second compartment containing a second composition and a substantially spherical rigid spacer being located in the first compartment and/or the second compartment, such that a wall or wall section of the first and/or second compartment is prevented from contacting a wall or wall section of the other compartment.

2. A water-soluble container comprising a first compartment containing a first composition and sealed with a sealing member, said sealing member comprising a second compartment containing a second composition and a rigid spacer comprising a composition that is enclosed in a housing formed of a water soluble polymer, said rigid spacer being located in the first compartment and/or the second compartment, such that a wall or wall section of the first and/or second compartment is prevented from contacting a wall or wall section of the other compartment.

3. A container according to claim 1, wherein more than 30% of the surface area of the second compartment is enclosed by the first compartment.

4. A container according to claim 3, wherein more than 50% of the surface area of the second compartment is enclosed by the first compartment.

5. A container according to claim 1 wherein the second composition is moisture-sensitive.

6. A container according to claim 1 wherein the first compartment and/or the second compartment is formed of poly (vinyl alcohol).

7. A container according to claim 1 wherein the first compartment and/or the second compartment comprises means for retaining the spacer in position.

8. A container according to claim 7, wherein a wall section of the first compartment and/or the second compartment comprises a recess for the spacer.

9. A container according to claim 1 wherein the first compartment has been formed by thermoforming or injection moulding.

10. A container according to claim 1 wherein the first composition is a liquid.

11. A container according to claim 1 wherein the second composition is a solid or a liquid.

12. A container according to claim 11, wherein the second composition is a compressed solid or a particulate solid.

13. A container according to claim 1, wherein the water-soluble polymer is applied by spray coating.

14. A container according to claim 1 which comprises more than one spacer.

15. A container according to claim 1 which is suitable for use in laundry or ware washing.

16. A container according to claim 1 wherein the spacer is positioned in the first compartment.

17. A process for producing a container according to claim 1, said process comprising:

i) forming an open container, positioning the spacer in the open container, at least partially filling the container with the first composition and with the second compartment containing the second composition, and sealing the container; or ii) forming an open container, positioning the spacer in the open container, at least partially filling the container with the first composition, and sealing the container with a sealing member comprising the second compartment containing the second composition.

* * * * *